US006481367B2

(12) United States Patent
McClosky

(10) Patent No.: US 6,481,367 B2
(45) Date of Patent: Nov. 19, 2002

(54) COMBINATION PEN HOLDER AND BOOKMARK/PLACESAVER

(76) Inventor: Lucinda Charmay McClosky, 6418 Brookgate, Spring, TX (US) 77373

( * ) Notice: Subject to any disclaimer, the term of this patent is extended or adjusted under 35 U.S.C. 154(b) by 29 days.

(21) Appl. No.: 09/750,561

(22) Filed: Dec. 28, 2000

(65) Prior Publication Data

US 2002/0083884 A1 Jul. 4, 2002

(51) Int. Cl.[7] ..... B42D 9/00
(52) U.S. Cl. ..... 116/235; 116/234; 116/239
(58) Field of Search ..... 116/234–239

(56) References Cited

U.S. PATENT DOCUMENTS

| | | | | | |
|---|---|---|---|---|---|
| 139,936 | A | * | 6/1873 | Ward et al. | 116/235 |
| 480,649 | A | * | 8/1892 | Bailey et al. | 116/235 |
| 865,092 | A | * | 9/1907 | Erickson | 116/235 |
| 1,100,780 | A | * | 6/1914 | Ridenour | 116/238 |
| 2,300,216 | A | * | 10/1942 | Grodsky et al. | 116/237 |
| 2,344,613 | A | * | 3/1944 | Hellstern | 116/237 |
| 2,674,972 | A | * | 4/1954 | Luther | 116/236 |
| 2,716,390 | A | * | 8/1955 | Goins | 116/235 |
| 3,712,712 | A | * | 1/1973 | Bosma | 116/119 |
| 4,162,800 | A | | 7/1979 | Gonot, Jr. | |
| 4,505,219 | A | * | 3/1985 | Mangano | 116/234 |
| 4,706,995 | A | | 11/1987 | Dopp | |
| 4,838,198 | A | | 6/1989 | Knox | |
| 4,984,529 | A | * | 1/1991 | Dickson | 116/234 |
| 5,095,846 | A | | 3/1992 | Knight | |
| 5,103,758 | A | * | 4/1992 | Clark | 116/237 |
| 5,456,497 | A | * | 10/1995 | Ross, Jr. | 116/237 |
| D365,363 | S | * | 12/1995 | Terino | D19/34 |
| 5,501,171 | A | | 3/1996 | Leake | |
| 5,596,821 | A | * | 1/1997 | Solo | 36/136 |
| 5,881,434 | A | | 3/1999 | Rigney | |
| 6,182,878 | B1 | * | 2/2001 | Racca | 224/605 |
| 6,205,947 | B1 | * | 3/2001 | Drew | 116/238 |
| 6,354,723 | B1 | * | 3/2002 | Spence | 362/540 |

FOREIGN PATENT DOCUMENTS

| | | | | |
|---|---|---|---|---|
| GB | 1632 | * | 11/1902 | 116/119 |
| GB | 24930 | * | 10/1909 | 116/238 |

OTHER PUBLICATIONS 282998 complete specification, Figs. 1–5, date unknown.*

* cited by examiner

*Primary Examiner*—Christopher W. Fulton
*Assistant Examiner*—Gail Verbitsky
(74) *Attorney, Agent, or Firm*—Mary J. Gaskin

(57) ABSTRACT

A bookmark/placesaver in combination with a holder for writing implements is disclosed. The holder portion includes a strip of material with complementary mating elements. The strip of material is wrapped around the front cover of a book and the mating elements are attached. An optional lengthening element allows the device to be used on large books. A bookmark with a placesaver allows the reader to mark a page and passage of a book. An optional magnifier can be included on the placesaver.

8 Claims, 4 Drawing Sheets

COMBINATION PEN HOLDER AND BOOKMARK/PLACESAVER

BACKGROUND OF THE INVENTION

The invention relates to a pen/pencil/marker holder in combination with a bookmark/placesaver, which optionally includes a magnifying lens.

Readers often wish to underline or mark passages or to jot notes in margins. They would value the convenience of having a device to store a pen or highlighter with books they are reading.

A reader would also find a bookmark useful for marking the page he has finished reading. Even more useful would be a bookmark which acts as a placesaver, indicating the very passage which one has completed.

A device which combines these functions would be especially useful. Combination pen holders/bookmarks have been disclosed in the prior art, for example, Fred P. Gonot, Jr. et al., U.S. Pat. No. 4,162,800; Kip H. Dopps, U.S. Pat. No. 4,706,995; John R. Knight, U.S. Pat. No. 5,095,846; Linda S. Leake, U.S. Pat. No. 5,501,171; and Douglas E. Rigvey, U.S. Pat. No. 5,881,434. However, none of these are especially easy to use, and several could damage the spines or pages of the books with which they are used. In particular, U.S. Pat. No. 4,162,800 discloses a bookmark/holder which functions like a giant rubber band, having slits or openings for a pen. The elastic portion could damage pages, and the pen, which is poorly secured, could easily be lost. None of them disclose a placesaver.

SUMMARY OF THE INVENTION

The present invention has a strip of material, with an optional elastic segment, the ends of which are wrapped around the cover of a book and fastened together with complementary Velcro™ strips. An optional telescoping strip with Velcro™ allows the present invention to be used on large books. A pocket for holding one or more pens or markers is mounted on the front section of the strip. A ribbon of material is attached to the front section of the strip. The ribbon is used as a bookmark. Threaded onto the ribbon is a placesaver arrow, which can be used to indicate the passage of the book which the reader last read. An optional magnifier can be mounted onto the arrow.

It is an object of the present invention to provide a utilitarian, yet attractive, combination pen holder and bookmark/placesaver, which gives a reader easy access to and storage of writing instruments, as well as a device for relocating the page of the book, as well as the last passage, that he has read.

It is yet another object of the invention to provide a combination pen holder and bookmark/placesaver which is easy to install and is easy to use.

A further object of the invention is to provide a combination pen holder and bookmark/placesaver which is adjustable, depending on the size of the book.

Other objects of the invention will become obvious when the embodiment is more fully described in the specifications.

BRIEF DESCRIPTION OF THE DRAWINGS

In FIG. 6A, the open strip of material has been laid on the inside of a book cover, and the bookmark/placesaver has been inserted to point to a passage in the book. In FIG. 6B, the bookmark ribbon has been pulled down and the book has been closed. In FIG. 6C, the lower portion of the invention has been folded over the front cover of the book. In FIG. 6D, the upper portion of the device has been pulled over and affixed to the lower portion. Two pens have been inserted into the holding pocket, and the flap is ready to be closed.

DESCRIPTION OF PREFERRED EMBODIMENT

Figure 1:
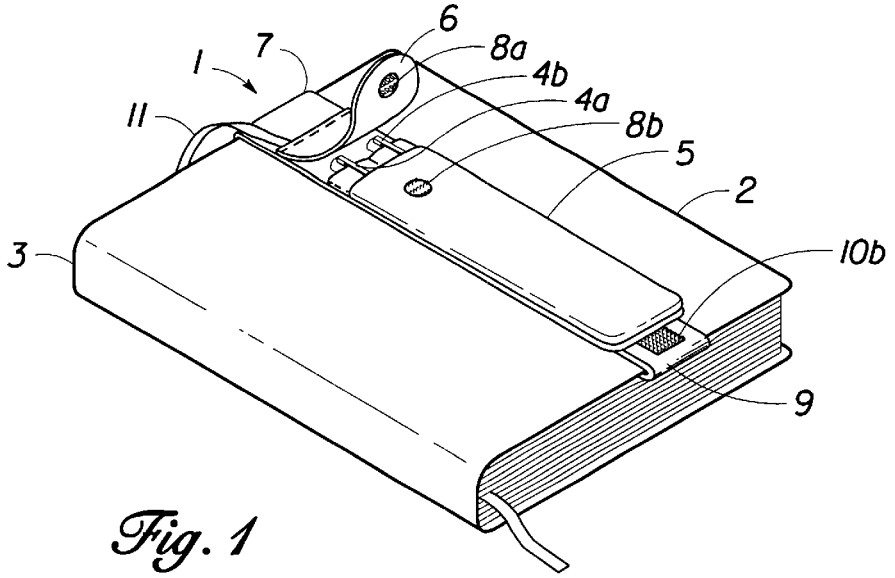
FIG. 1 is a perspective view showing the combination pen holder and bookmark/placesaver of the present invention.

Referring to the drawings, the combination pen holder and bookmark/placesaver of the present invention is referred to generally as the device 1. The device 1 has been wrapped around the cover 2 of a book 3, and the book 3 has been closed. Two writing instruments 4*a*, 4*b*, which can be pens, pencils, markers, highlighters, or other such implements, have been stored in the pocket 5 of the device 1. A flap 6 which can be closed over the writing instruments 4*a*, 4*b* has been attached to top strap 7, by sewing or other means. Velcro™ circles 8*a*, 8*b* can be used to keep the flap 6 closed. The pocket 5 is fastened to the bottom strap 9 with Velcro™ strips 10*a* (not shown), 10*b*. A ribbon 11, which functions as a bookmark, is attached to the top strap 7, by sewing or other means. The device 1 is shown and described in more detail infra.

Figure 2:
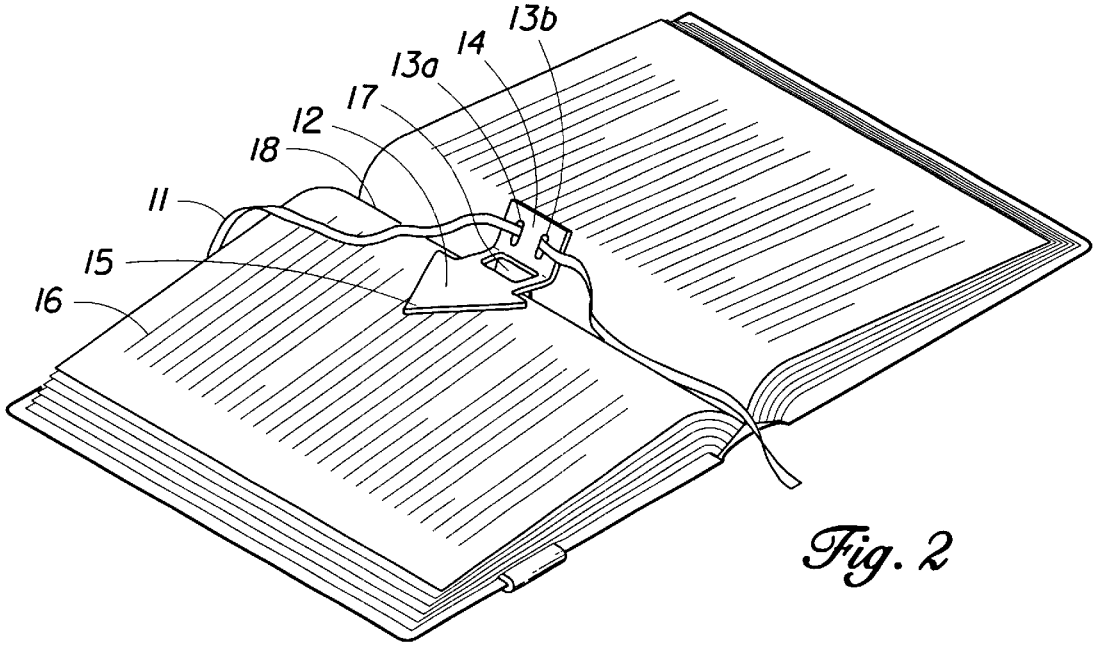
FIG. 2 is a perspective view of an open book, showing the bookmark/placesaver portion in use.

The bookmark ribbon 11 and the placesaver arrow 12 are shown in FIG. 2. The ribbon 11 has been inserted through openings 13*a*, 13*b* in the extension 14 of the placesaver arrow 12. The pointer 15, the end of the placesaver arrow 12, is placed next to the portion of the text 16 which the reader wishes to "mark" (i.e., he has just finished the passage or he will return to the passage when he resumes reading). The stiff insert 17 has been pushed into the crease 18 between the pages of the book 3 to keep the placesaver arrow 12 from moving around. The end of the ribbon 11 can be pulled down to dangle past the bottom edge of the book 3; the ribbon will move freely through the openings 13*a*, 13*b* of the placesaver arrow 12.

Figure 3:
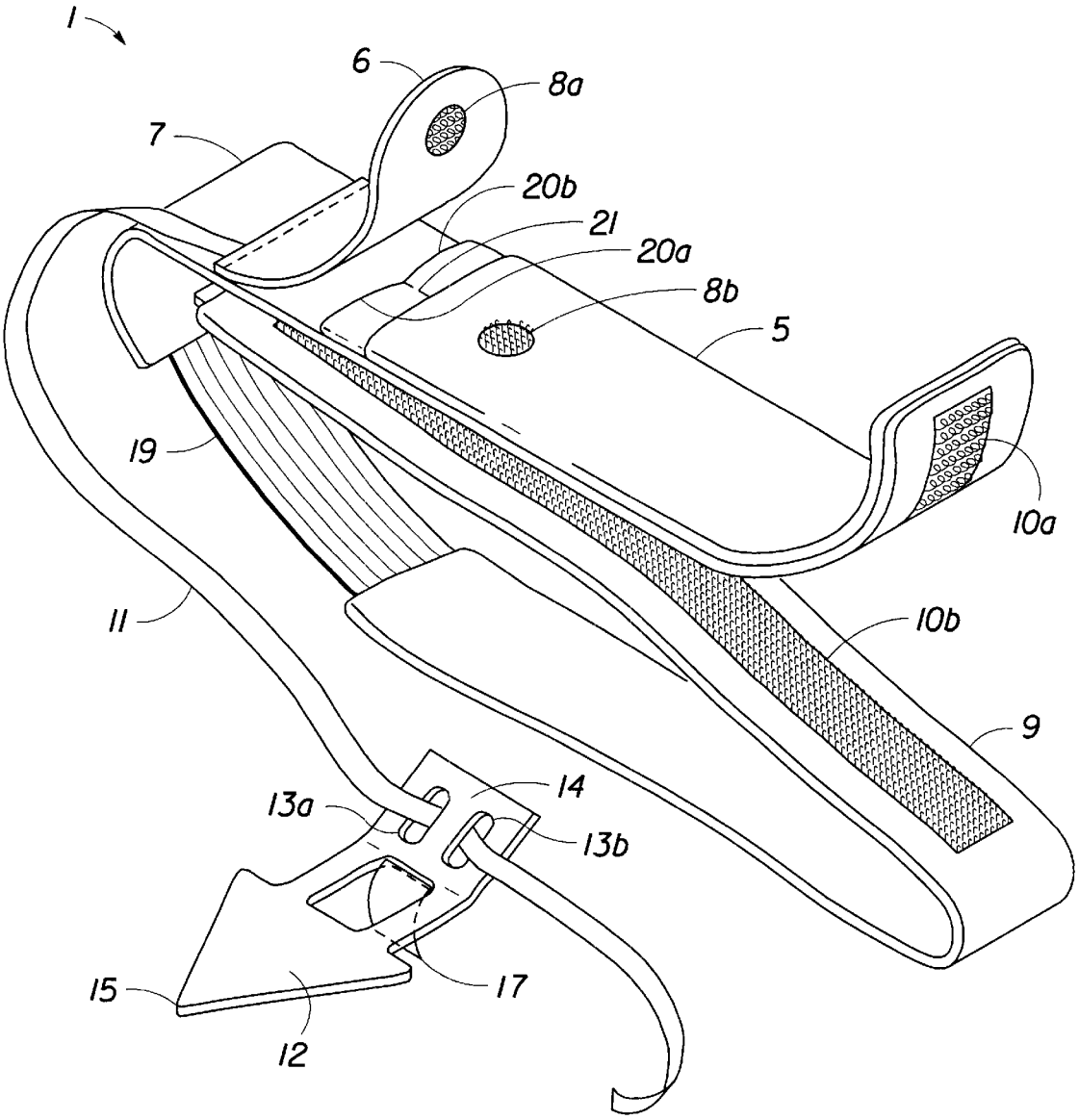
FIG. 3 is a perspective view showing the combination penholder and bookmark/placesaver of the present invention, showing the elastic portion and also the Velcro™ strips and circles.

As shown in FIG. 3, the device 1 is assembled in a unitary fashion. The pocket 5, the flap 6, the top strap 7, and the bottom strap 9 are generally made from a fabric material, which can be selected from patterned fabrics for added attractiveness. These pieces can also be made from sturdier materials, such as leather or plastic.

A piece of flat elastic 19 connects the top strap 7 and the bottom strap 9, allowing the reader to slightly stretch the elastic strip 19 and thereby snugly attach the device I to a book cover when mating the Velcro™ strips 10*a*, 10*b*. A second partitioned pocket 20*a*, 20*b* can be created by adding additional material and sewing a divider seam 21. The partitioned pocket 20*a*, 20*b* can hold two pens, while the main pocket 5 holds one large writing instrument or other implement.

The ribbon 11 shown is typically made from fabric material. The placesaver arrow 12 is generally made of the same material as the pocket 5, the flap 6, the top strap 7, the bottom strap 9, such as fabric, leather or plastic. The stiff insert 17 is made of plastic. The extension 14 and the arrow 12 may be reinforced with additional material or plastic.

Figure 4A:
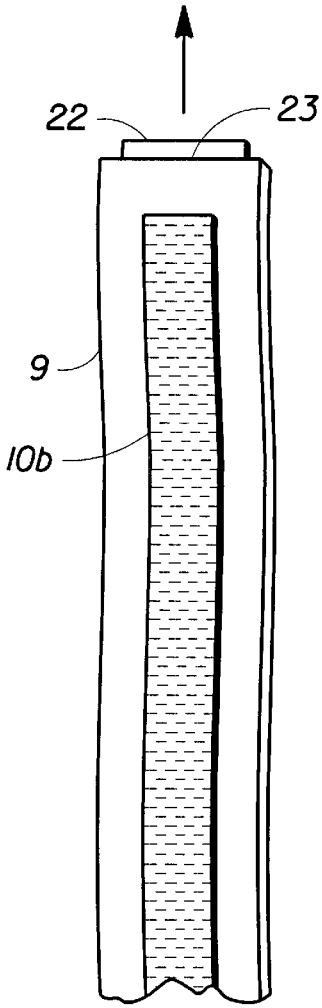
FIGS. 4A–4B are details showing the optional adjustable telescoping Velcro™ strip.
Figure 4B:
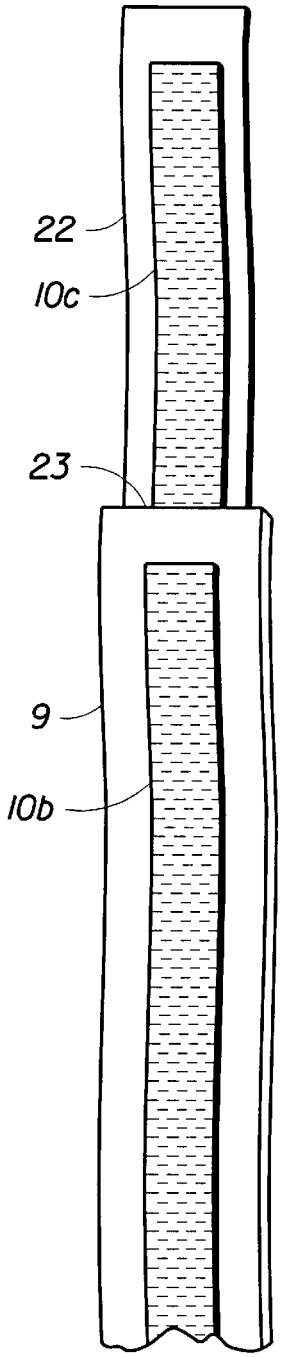

FIGS. 4A–4B show an optional feature to make the device 1 adjustable for use with a larger book. A telescoping strip 22 covered with an additional Velcro™ strip 10*c* can be inserted into a slit 23 formed at the free end of bottom strap 9. The telescoping strip 22 can be slid out to add length to the Velcro™ strip 10*b* on the bottom flap 9, thereby allowing improved mating with the Velcro™ strip 10*a* on top strap 7, particularly when the reader is using the device 1 with a large book.

Figure 5:
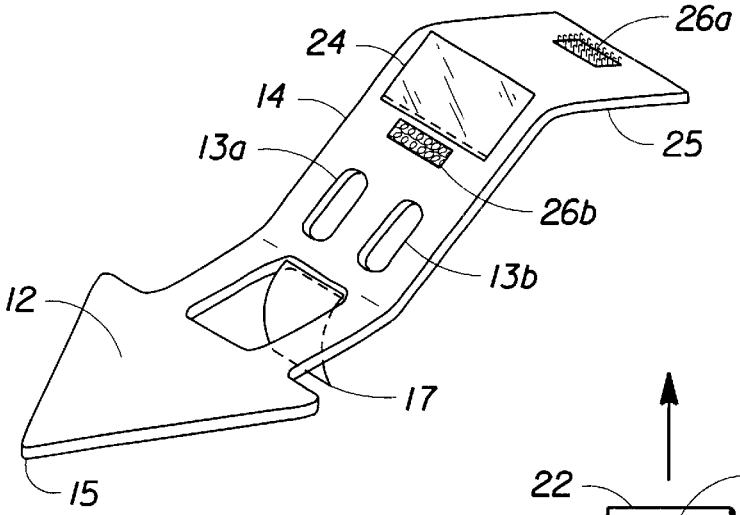
FIG. 5 is a detail showing the optional magnifier attached to the placesaver arrow.

FIG. 5 shows a optional magnifier, which can be used to enhance the usefulness of the placesaver arrow 12. A side of a rectangular magnifier 24, made from plastic or glass, can be attached to the extension 14 of the placesaver arrow 12, ordinarily by sewing or gluing. A protective flap 25, comprising a long rectangular piece of material, is also attached to the extension 14, under the magnifier 24. The Velcro™ closure 26*a* on the end of the protective flap 25 mates with a Velcro™ closure 26*b* on the extension 14, allowing the reader to fold the protective flap 25 over the magnifier 24, to prevent scratching its surface. The reader can pull back the protective flap 25 and use the magnifier 24 to read small type.

Figure 6A:
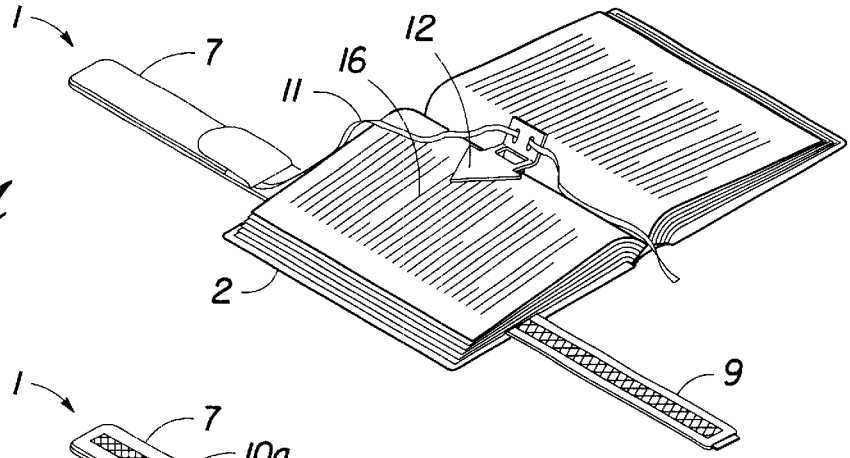
FIGS. 6A–6D show the method of using the combination pen holder and bookmark/placesaver of the present invention.

As shown in FIG. 6A, the reader has laid the length of the device 1 over the inside of a book cover 2. He has used the bookmark ribbon 11 to mark a page and has used the placesaver arrow 12 to mark a place in the text 16.

Figure 6B:
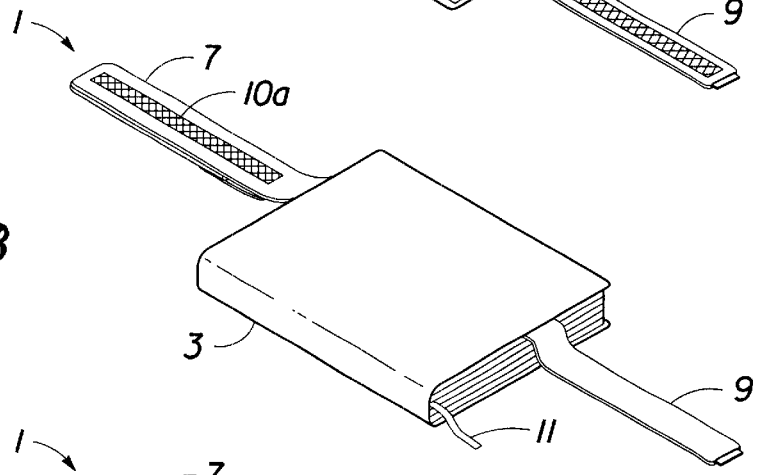

In FIG. 6B, the book 3 has been closed. The bookmark ribbon 11 marks the page.

Figure 6C:
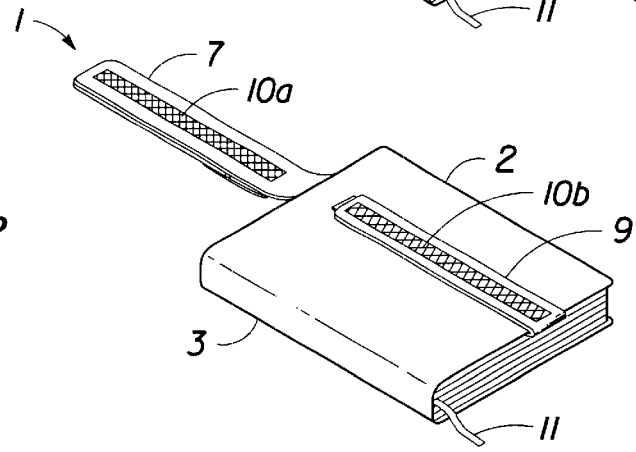

In FIG. 6C, the bottom strap 9 has been folded over the front of the book cover 2.

Figure 6D:
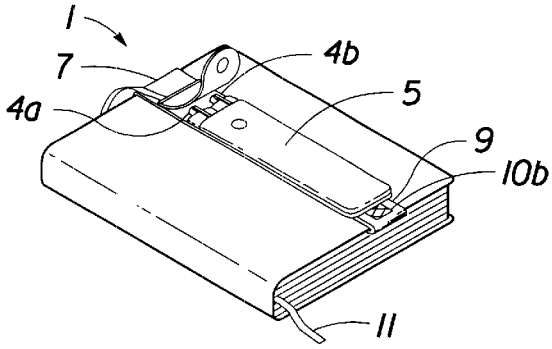

In FIG. 6D, the top strap 7, with the pocket 5, has been folded over the bottom strap 9, pulled tight, and secured thereto with Velcro™ strips 10*a* (not shown), 10*b*. Pens 4*a*, 4*b* have been inserted into the pocket 5.

I claim:

1. A combination holder and bookmark for use with a book having a spine and a front cover with a height parallel to the spine, comprising:

a strip having a front face and a back face and having a length more than two times and less than three times as long as the height of the front cover, the strip having an inelastic first segment; an elastic second segment, and an inelastic third segment, the elastic second segment being disposed between the inelastic first segment and the inelastic third segment;

a first fastening element attached to the back face of the inelastic first segment;

a second fastening element complementary to the first fastening element, said second fastening element attached to the front face of the inelastic third segment;

a pocket formed on the front face of the inelastic first segment, said pocket having an opening to a cavity adapted for receiving at least one writing instrument;

a fabric ribbon having a first end and a second end, the first end being attached to the front face of the inelastic first segment.

2. The combination holder and bookmark of claim 1 wherein the first fastening element and the second fastening element comprise a system selected from a group consisting of a loop and hook fastening system, a hook and eye fastening system, and a system of complementary snaps.

3. The combination holder and bookmark of claim 1 further comprising a bendable, arrow-shaped placesaver having a triangular portion, an extension with openings through which the second end of the ribbon is threaded, and a stiff rectangular insert attached to the placesaver.

4. The combination holder and bookmark of claim 1 which further comprises:

a flap having a first end and a second end, the first end being attached to the front face of the inelastic first segment, and the second end of said flap extending over the opening of the pocket;

means for removably attaching the second end of the flap to the pocket.

5. The combination holder and bookmark of claim 4 wherein the means for removably attaching the second end of the flap to the pocket is selected from a group consisting of a loop and hook fastening system, a hook and eye fastening system, and a system of complementary snaps.

6. The combination holder and bookmark of claim 3, wherein the arrow-shaped placesaver further comprises a rectangular magnifier and a protective covering, both attached to the extension.

7. The combination holder and bookmark of claim 1 wherein the inelastic third segment has an unattached end with an opening for accomodating a telescoping, rigid strip having a front face with a fastening element which supplements the second fastening element attached to the first face of the inelastic third segment.

8. The combination holder and bookmark of claim 7 wherein the fastening elements comprise a loop and hook fastening system.

* * * * *